US005466902A

United States Patent [19]

Blom et al.

[11] Patent Number: 5,466,902

[45] Date of Patent: Nov. 14, 1995

[54] SWITCH OPERATOR AND INTERLOCK MECHANISM

[75] Inventors: Leo E. Blom, Sanford; Eldridge R. Byron, Lake Mary, both of Fla.

[73] Assignee: ABB Power T&D Company Inc., Blue Bell, Pa.

[21] Appl. No.: 157,385

[22] Filed: Nov. 23, 1993

[51] Int. Cl.[6] ..... H01H 9/20; H01H 33/46

[52] U.S. Cl. ..... 200/50 AA; 200/17 R

[58] Field of Search ..... 200/17 R, 18, 200/50 R–50 C, 144 R; 218/1; 307/80; 361/605, 608, 615, 616, 622, 627, 628, 631, 641, 643

[56] References Cited

U.S. PATENT DOCUMENTS 3,881,076 4/1975 Latka et al. ..... 200/61.54
4,034,170 7/1977 Raabe et al. ..... 200/50 A
4,107,486 8/1978 Evans ..... 200/48 R
4,295,054 10/1981 Kovatch et al. ..... 307/80
4,405,844 9/1983 Dizon et al. ..... 200/50 A

*Primary Examiner*—Kristine L. Kincaid
*Assistant Examiner*—Michael A. Friedhofer
*Attorney, Agent, or Firm*—Woodcock Washburn Kurtz Mackiewicz & Norris

[57] ABSTRACT

Switch operator having an actuator, a drive mechanism coupled to the switch for actuating a switch in response to a rotational force applied to the drive mechanism, and a flexible shaft which couples the actuator to the drive mechanism and communicates the rotational motion of the actuator to the drive mechanism. An interlock mechanism prevents the actuation of a second switch as a function of a first switch and prevents the opening of a door as a function of the position of the first switch.

3 Claims, 5 Drawing Sheets

SWITCH OPERATOR AND INTERLOCK MECHANISM

FIELD OF THE INVENTION

The present invention is related generally to electrical switch gear and more particularly, to a switch operator for actuating a switch disposed in an electrical switch gear cabinet and to a switch interlock mechanism that meets safety locking requirements.

BACKGROUND OF THE INVENTION

Switch operators are used to provide actuation of switches located in the housing of primary entrance units or electrical switch gear cabinets. The actuators of switch operators are commonly located on the outside of the housing of electrical switch gear cabinets. The switches themselves are mounted somewhere inside the cabinet. The actuators typically include a handle to facilitate their movement. Because of the relative locations of the switch actuators and the switches they control, some mechanism must be provided for coupling the movement of each actuator to its respective switch. Previously, switch operators have employed chain drive mechanisms to transfer the motion of an actuator to its respective switch. Other switch operators have employed shafts with universal joints to provide the coupling of an actuator to its respective switch. The assembly of such coupling devices is complicated and time consuming. For example, to assemble a coupling device comprised of a chain drive mechanism, the chain generally must be cut to length, connected and then aligned. Consequently, there is a need for a switch operator that is simple, inexpensive and easy to install.

Interlock mechanisms are used to limit the operation of switch operators to meet safety locking requirements. Previously, interlock mechanisms have employed a Kirk lock to meet the safety locking requirements. A Kirk lock is a locking mechanism that prevents switch actuation unless a corresponding key is inserted in the Kirk lock. After the key is inserted, a user may actuate a switch. Ideally, the key should be kept at a separate and controlled location from the switch operator. The Kirk lock provides only a minimum level of safety protection for the user of the switch operator. In addition, if the key is lost or misplaced, a user may not be able to actuate a switch when required. Accordingly there is need for an interlock mechanism that provides the safety locking requirements without the use of a Kirk lock.

The present invention satisfies these needs.

SUMMARY OF THE INVENTION

The present invention is directed to a switch operator which, in part, uses a flexible shaft to actuate a switch thereby reducing the complexity and time of assembly of the switch operator. The present invention is also directed to an interlock mechanism that prevents closure of a switch as a function of the position of a door, prevents opening of the door as a function of a position of the switch, and prevents actuation of a second switch as a function of the position of the first switch.

According to one aspect of the invention, a switch operator of the present invention includes an actuator and a drive mechanism coupled to the switch for actuating the switch in response to a rotational force applied to the drive mechanism. The switch operator also includes a flexible shaft which couples the actuator to the drive means and communicates the rotational motion of the actuator to the drive mechanism.

According to another aspect of the invention, an electrical switch cabinet of the present invention has a first and second switch and a first and second switch operator. The first switch operator includes a first actuator and a first drive mechanism coupled to the first switch for actuating the first switch in response to a rotational force applied to the first drive mechanism. The first switch operator also includes a first flexible shaft which couples the first actuator to the first drive mechanism and communicates the rotational motion of the first actuator to the first drive mechanism. The second switch operator includes a second actuator and a second drive mechanism coupled to the second switch for actuating the second switch in response to a rotational force applied to the second drive mechanism. The second switch operator also includes a second flexible shaft which couples the second actuator to the second drive mechanism and communicates the rotational motion of the second actuator to the second drive mechanism.

According to a further aspect of this invention, the electrical switch cabinet also includes an interlock mechanism. The interlock mechanism includes switch interlock means for preventing the actuation of the second switch as a function of the first switch.

According to a further aspect of this invention, the interlock mechanism of the electrical switch cabinet also includes prevention means for preventing the opening of the door as a function of the position of the first switch.

According to a further aspect of this invention, the interlock mechanism of the electrical switch cabinet also includes actuation means for preventing the actuation of the first switch as a function of the position of the door.

According to another aspect of the invention, an interlock mechanism for an electrical cabinet having first and second switches and a door, includes switch interlock means for preventing the actuation of the second switch as a function of the first switch and prevention means for preventing the opening of the door as a function of the position of the first switch.

According to a further aspect of the invention, the interlock mechanism also includes actuation means for preventing the actuation of the first switch as a function of the position of the door.

DETAILED DESCRIPTION OF PREFERRED EMBODIMENTS

Figure 1:
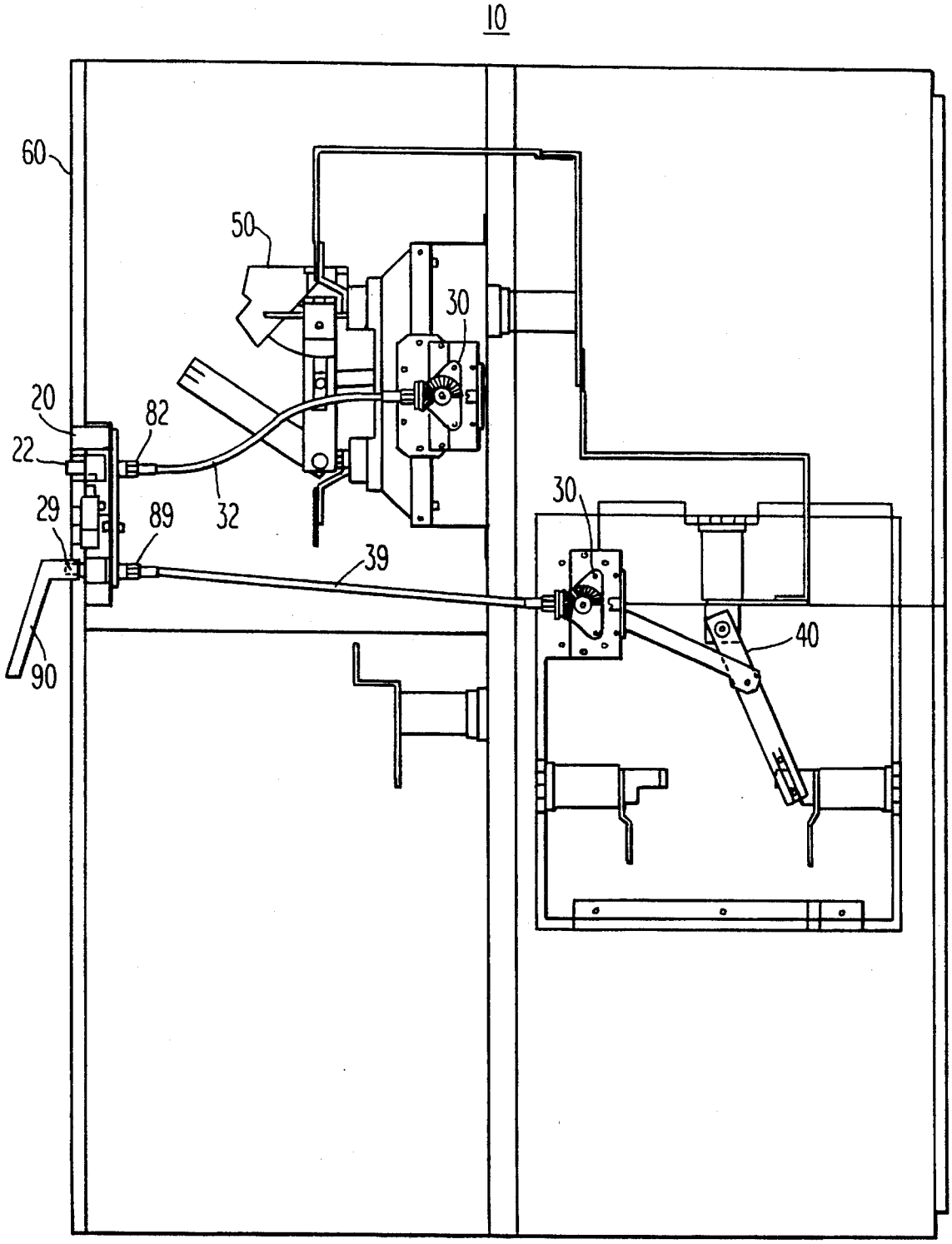
FIG. 1 is a diagram of an exemplary electrical switch gear cabinet depicting an exemplary configuration of switch operators and an interlock mechanism in accordance with a preferred embodiment of the invention.

Referring to the drawings wherein like numerals indicate like elements throughout, there is shown in FIG. 1 an exemplary electrical switch cabinet or primary entrance unit 10 embodying exemplary switch operators and an exemplary interlock mechanism of this invention. A brief overview of the invention is presented by reference to this exemplary cabinet 10. The exemplary cabinet 10 includes a door 60, two exemplary switch operators 82 and 89 which actuate switch 50 and switch 40, respectively, and an interlock mechanism 20.

In the exemplary cabinet 10 shown in FIG. 1, the switch 50 is an interrupter switch used to connect or disconnect a load (not shown) from a source of power. Switch 40 is a line selector switch used to select the source of power supplied to the switch 50 and subsequently the load. The switch 50 is actuated by the switch operator 82 in order to open and close the switch. Similarly, the switch 40 is actuated by the switch operator 89 in order to switch the source of power from one line to another.

In addition, in the exemplary cabinet 10: (i) the actuation of switch 40 is limited as a function of the position of switch 50, i.e., whether opened or closed; (ii) the actuation of switch 50 is limited as a function of whether the door 60 is opened or closed; and, (iii) the operation of the door 60 is limited as a function of the position of switch 50.

According to the present invention, each switch operator 82 or 89 as shown in FIG. 1, comprises an actuator 22 or 29, a flexible shaft 32 or 39, and a drive mechanism 30. The actuators 22 and 29 are coupled to the respective flexible shafts 32 and 39. The flexible shafts 32 and 39 are, in turn, coupled to the respective drive mechanisms 30. The drive mechanisms 30 are coupled to the switches 40 and 50. Considering the operation of switch operator 82 in greater detail, when a rotational force is applied to the actuator 22 by its handle 90, a rotational force is applied (assuming the interlock mechanism 20 is not preventing movement of the actuator 22, as described hereinafter) to shaft 32 which, in turn, communicates that force to its respective drive mechanism 30. The drive mechanism 30, in turn, applies the rotational force to the switch 50 to actuate the switch 50. Switch operator 89 operates in the same manner to actuate switch 40. In the exemplary cabinet 10, actuation of switch 50 is used to connect or disconnect the source of power to the load, and switch 40 is used to select the source of power. Switch 50 is commonly referred to in the art as an interrupter switch, and switch 40 is commonly referred to as a line selector switch.

In the preferred embodiment of the invention, the flexible shafts 32 and 39 are formed of a metal, such as steel. Each shaft 32 or 39, while flexible, is sufficiently rigid to communicate a rotational force applied to one end of the shaft to the other end of the shaft.

Figure 2:
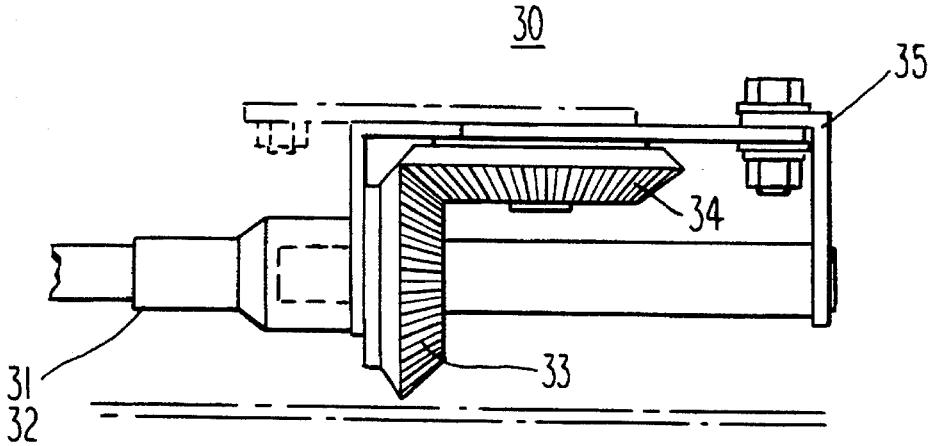
FIG. 2 is a side view of an exemplary drive mechanism of the switch operators of FIG. 1.
Figure 3:
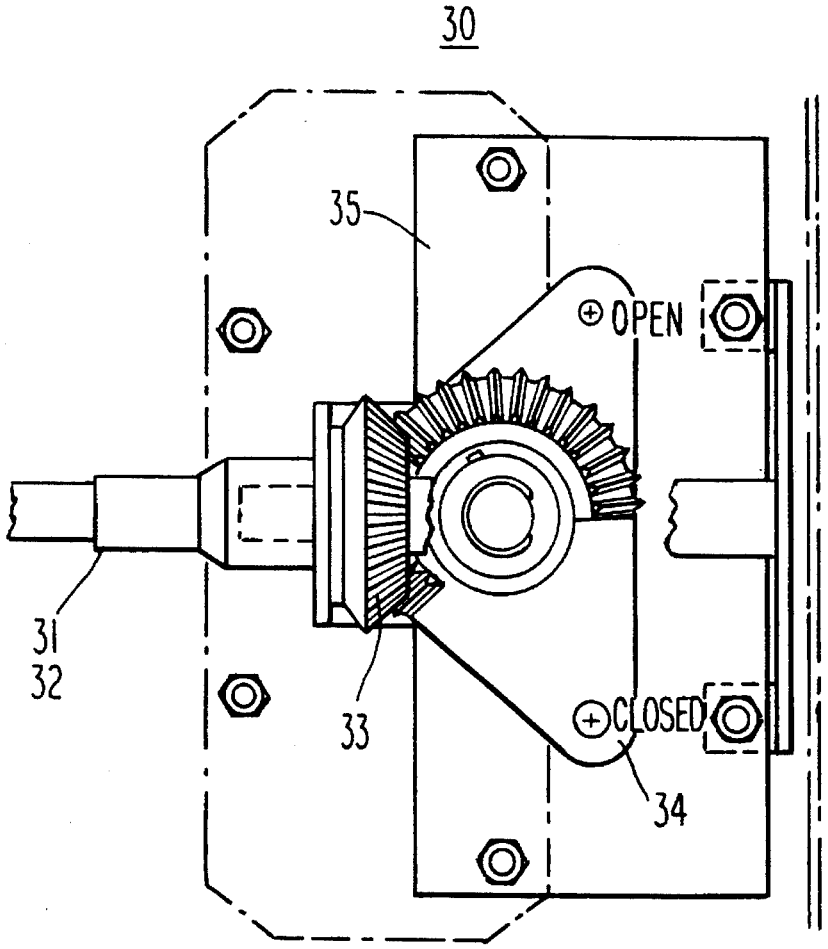
FIG. 3 is a top view of the exemplary drive mechanism shown in FIG. 2.

As shown in FIGS. 2 and 3, in the preferred embodiment, each drive mechanism 30 comprises a bevel gear drive 30. The bevel gear drive 30 includes an actuator pinion 33 and an actuator gear 34. The actuator pinion 33 is connected to a respective flexible shaft 32 or 39 and is matingly engaged to the actuator gear 34 so that when a rotational force is applied to the flexible shaft 32 or 39, the actuator pinion 33 will apply a rotational force to the actuator gear 34. In the preferred embodiment, the rotational force applied to the actuator gear is transverse to the direction of the rotational force applied to the flexible shaft 32 or 39 and actuator pinion 33. In the preferred embodiment, the actuator gear 34 is mounted on a support mount 35 and connected to the switch 50 or switch 40 so that when the actuator pinion 33 applies rotational force, the actuator gear 34 actuates the respective switch 50 or 40.

Considering the assembly of switch operator 82 in greater detail, the drive mechanism 30 must be connected to the switch 50, and the actuator 22 must be mounted on the housing of cabinet 10. The flexible shaft 32 is coupled at one end to the actuator 22 and at the other end to the drive mechanism 30. During assembly, the flexible shaft 32 may first need to be cut to the appropriate length, i.e., to a length that reaches from the actuator 22 to the corresponding drive mechanism 30. One or both ends of the flexible shaft 32 may also need to be fitted with interface devices (not shown) to facilitate coupling to the actuator 22 and the drive mechanism 30. Switch operator 89 is assembled in a similar manner. Overall, assembly of a switch operator of the present invention is less complicated and time consuming than the assembly of switch operators employing a chain drive or universal joints as described in the background of the invention. This is due to the employment of the flexible shaft in the switch operator of the present invention. In particular, to assemble a switch operator of the present invention, the flexible shaft (cut to an appropriate length) need only be connected to the actuator and the drive mechanism of the switch operator.

As noted above, the present invention further comprises an interlock mechanism 20 for use in the exemplary cabinet 10 that: (i) prevents closure of the switch 50 if the door 60 of the cabinet 10 is open; (ii) prevents opening of the door 60 of the cabinet 10 if the switch 50 is closed; and, (iii) prevents actuation of the switch 40 if the switch 50 is closed. The interlock mechanism 20 of the present invention comprises a plunger mechanism 71 (shown in FIGS. 4 and 6), an actuator interlock 21 (shown in FIGS. 5–7), and a hook mechanism 25 (shown in FIGS. 6 and 7).

Figure 4:
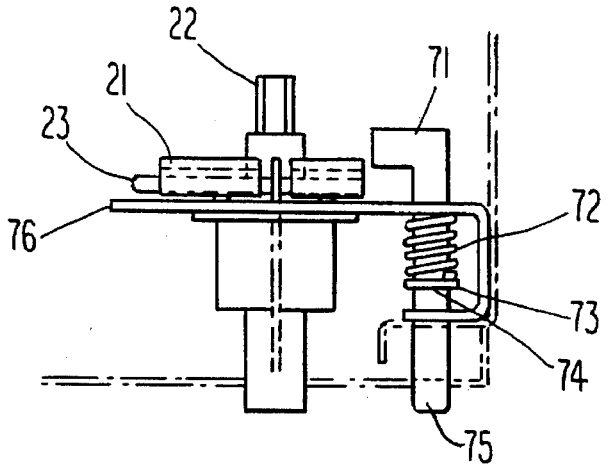
FIG. 4 is a diagram illustrating further details of the interlock mechanism of FIG. 1.
Figure 6:
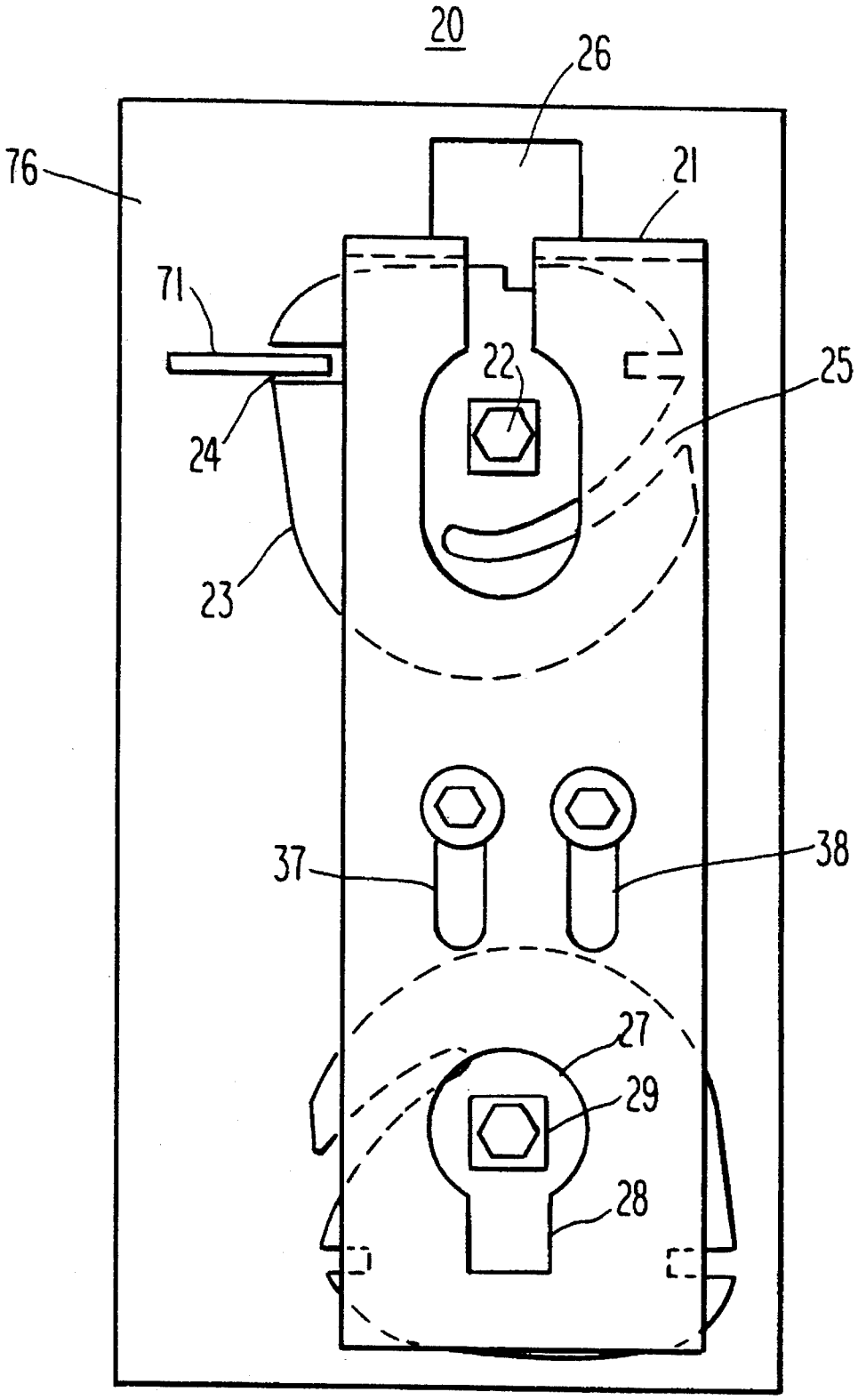
FIG. 6 illustrates the operation of the interlock mechanism of FIG. 4 when the actuator for the top switch operator is in the position corresponding to the open position for the switch.

In the preferred embodiment, the plunger mechanism 71 of the interlock mechanism 20 is used to prevent the closure of a switch (in the exemplary embodiment, switch 50) if the door 60 of the cabinet 10 is open. The operation and configuration of this aspect of the interlock mechanism 20 is described with reference to FIGS. 4 and 6. In particular, this aspect or interlocking feature of the invention uses the plunger 71 and a slotted cam 23 coupled to the actuator 22 of the switch 50. The plunger 71 engages a slot 24 of the cam 23 when door 60 is open and the switch 50 is also open, thus preventing the rotation of the actuator 22. As a consequence, the switch 50 cannot be closed when the door 60 is open. In the preferred embodiment of the invention, when the door 60 of the cabinet 10 is closed, the plunger 71 is depressed by the door 60 and disengaged from the slot 24 of the cam 23 thus allowing actuation of the switch 50. FIGS. 4 and 6 show a preferred configuration of the plunger 71 and cam 23.

In particular, as shown in FIG. 4, the plunger 71 is mounted in the interlock mechanism 20 and rests against a support 76 of the mechanism 20. The plunger 71 is coupled to a plunger spring 72, a washer 73, and a spring pin 74. In the preferred embodiment, the plunger spring 72, washer 73, and spring pin 74 are configured so that the rear extension of the plunger 71 facing into the cabinet 10 rests against the support 76 unless pressure is applied against the front extension 75 of the plunger 71.

As best shown in FIG. 4, if pressure is applied to the front extension 75 of the plunger 71 in a direction toward the rear of the cabinet 10, the plunger 71 will extend further to the rear of the cabinet and thus will not rest against the support 76 and will not engage the slot 24. When the door 60 of the cabinet is closed, the door applies such a pressure to the front extension 75 of the plunger 71. If the door is open, however, the spring 72 will force the plunger 71 to rest against the support 76.

The plunger 71 is shown in FIG. 6 in relation to the cam 23 of the actuator 22 of the switch 50. As shown, the cam 23 is directly coupled to the actuator 22 so that when the cam 23 is prevented from moving by the plunger 71 engaging the slot 24, the actuator 22 is also prevented from moving and thus the switch 50 is prevented from being actuated. In FIG. 6, the cam 23 and the actuator 22 are shown in the position corresponding to the open position of the switch 50. When the door 60 is also open, the slot 24 of the cam 23 engages the rear extension of the plunger 71.

Referring again to FIG. 4, in the preferred embodiment, the thickness of the cam 23 and configuration of the rear extension of the plunger 71 are selected so that when the door is closed the plunger 71 will not engage the slot 24 of the cam 23. Thus, when the door 60 is closed, the actuator 22 may be rotated to close the switch 50. However, as explained above, the plunger 71 and the slot 24 in the cam 23 prevent closure of the switch 50 when the door 60 is open.

Figure 7:
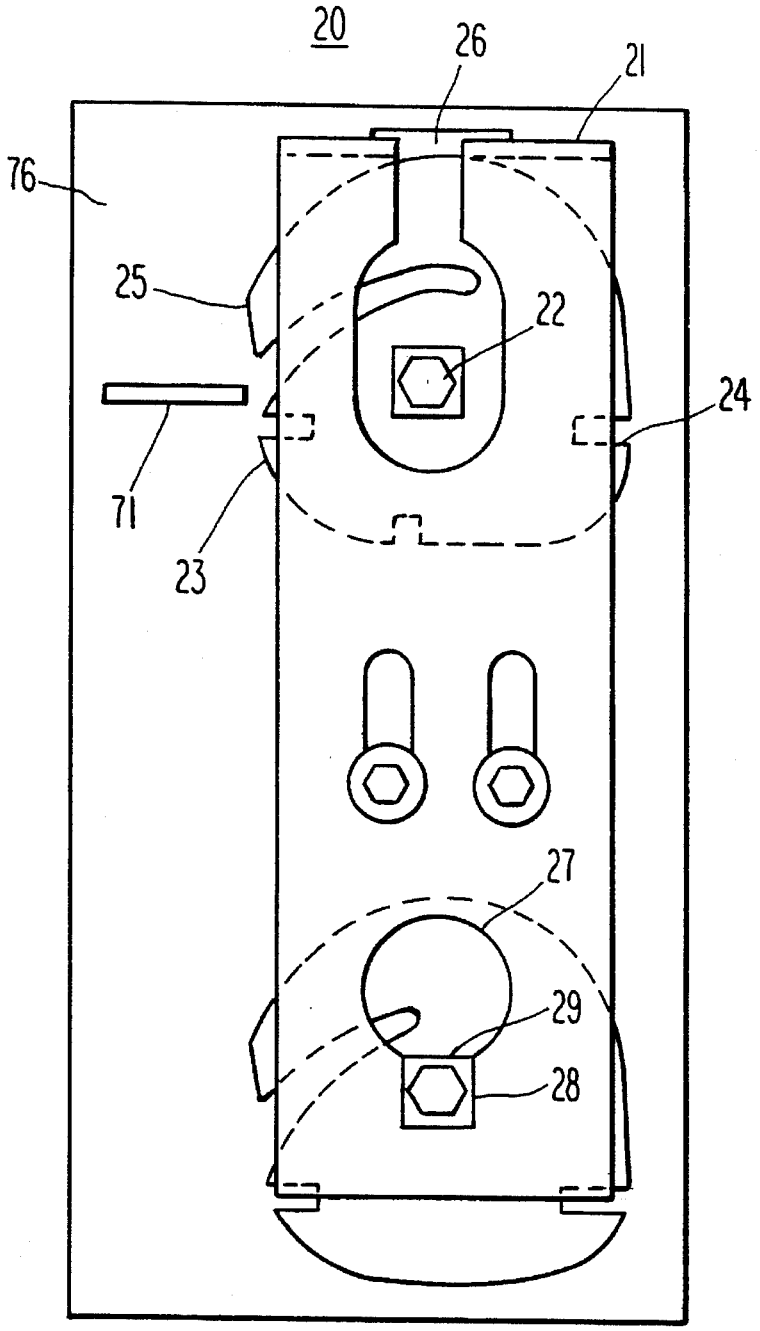
FIG. 7 illustrates the operation of the interlock mechanism of FIG. 4 when the actuator for the top switch operator is in the position corresponding to the closed position for the switch.
Figure 8:
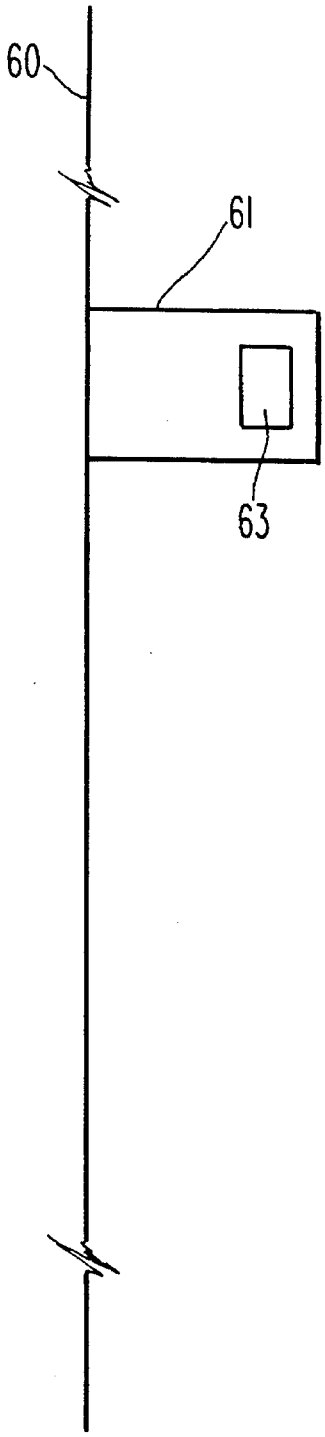
FIG. 8 is a diagram of an exemplary configuration of a hasp for the door of the electrical switch cabinet of FIG. 1.

As noted above, the interlock mechanism 20 also prevents the opening of the door 60 when the switch 50 is closed. In the preferred embodiment, a hooked cam 23 (FIG. 7) and a hasp 61 on the door 60 (FIG. 8) are used to prevent the opening of the door 60 when the switch 50 is closed. The operation and configuration of this aspect of the interlock mechanism 20 is described with reference to FIGS. 5 to 8. In the preferred embodiment, a hook 25 in the cam 23 engages a slot 63 (FIG. 8) of the hasp 61 of the door 60 when the switch 50 is closed, thus preventing the opening of the door 60. When the actuator 22 is moved to the position corresponding to the open position of the switch 50, the hook 25 of the cam 23 disengages the slot 63 of the hasp 61 so that the door 60 may be opened. As shown in FIGS. 6 and 7, the hasp 61 of the door 60 enters the interlock mechanism 20 of the switch operator through a slot 26 in the mechanism 20. As shown in FIG. 8, the hasp 61 preferably has a rectangular slot 63 that the hook 25 of the cam 23 engages when the switch is closed. Thus, in the preferred embodiment, the door 60 of the cabinet 10 is prevented from being opened by the engagement of the hook 25 to the slot 63.

To summarize, during a cycle of opening and closing the switch 50, the components of the interlock mechanism 20, in particular, the plunger 71, the hook 25 and the slot 24 of the cam 23, and the hasp 61, interact to: (i) prevent closure of the switch 50 when the door 60 is open; and, (ii) prevent the door 60 from being opened when the switch 50 is closed. For example, if the door 60 is closed and the switch 50 is closed, the hook 25 will engage the slot 63 of the hasp 61 and the front extension 75 of the plunger 71 will be depressed rearward so that the rear extension of the plunger 71 will not rest against the support 76 and therefore will not engage the slot 24. In this situation, the door 60 is prevented from being opened, but the switch 50 can be actuated since the plunger 71 is not engaged with the slot 24. Thus, a clockwise rotational force may be applied by the handle 90 of the actuator 22, causing the switch 50 to be opened.

As the actuator 22 is being rotated clockwise, the hook 25 will also be rotated clockwise and will reach a point where the switch 50 is open. At this point, the hook 25 will no longer engage the slot of the hasp 61 as shown in FIG. 6. As a consequence, at this point, the door 60 may be opened. When the door 60 is opened, the rear extension of the plunger 71 will engage the slot 24 as shown in FIG. 6. Thus, the door 60 and the switch 50 will be open. Due to the engagement of the rear extension of the plunger 71 with the slot 24, the actuator 22 will not be able to be rotated counterclockwise. Thus, the switch 50 can not be closed when the door 60 is open. The actuator 22 can only be rotated to the closed position when the door 60 of the cabinet 10 is closed. As explained above, when the door 60 is closed, the door 60 depresses the front extension 75 of the plunger 71 and disengages the rear extension of the plunger 71 with the slot 24. With the rear extension of the plunger 71 disengaged with the slot 24, the actuator 22 may be rotated to close the switch 50.

Figure 5:
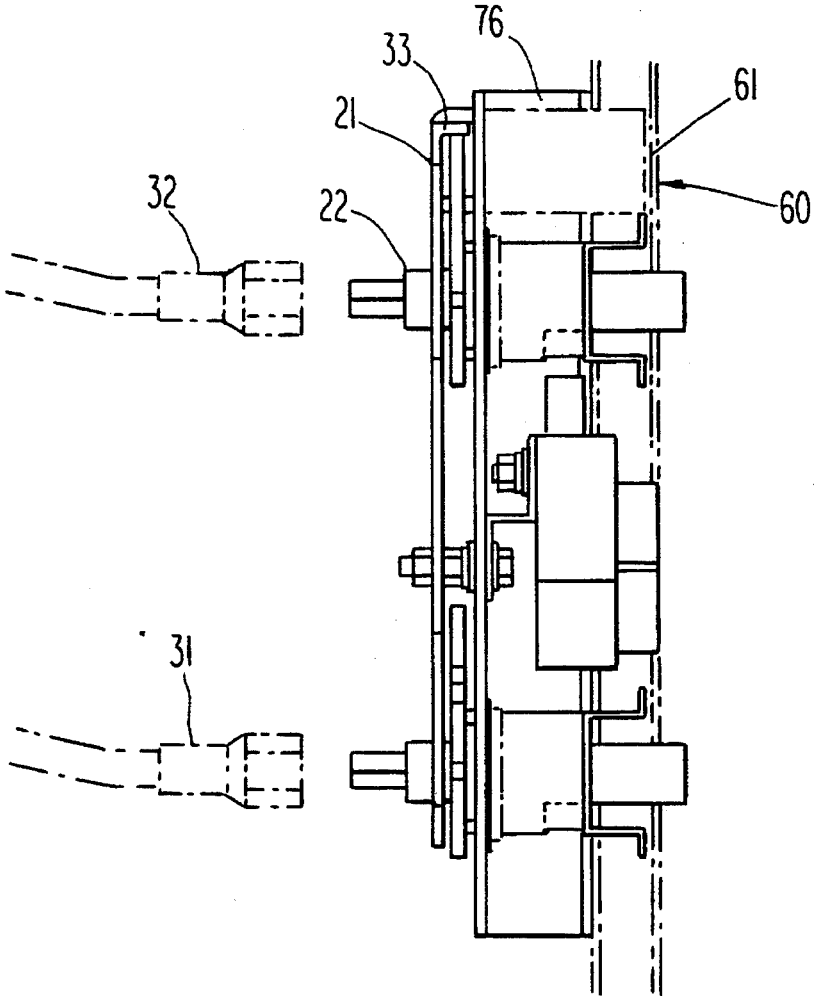
FIG. 5 is a diagram of an exemplary configuration of a plunger of the exemplary interlock mechanism of FIG. 1.

Finally, in addition to the two functions described above, the interlock mechanism 20 also prevents the actuation of switch 40 when the switch 50 is closed. Such a function is particularly useful in electrical switch gear, e.g., cabinet 10, that include both an interrupter switch and a line selector switch. However, this third function of the interlock mechanism 20 of the present invention may be used in any application in which it is desirable to control the actuation of one switch depending upon the position, or state, of another switch. According to the preferred embodiment, the cam 23 and an actuator interlock (sliding plate) 21 are used to prevent the actuation of switch 40 when the switch 50 is closed. The operation and configuration of this aspect of the interlock mechanism 20 are described with reference to FIGS. 5 to 7. In the preferred embodiment, as shown in FIG. 5, the cam 23 of the actuator 22 engages with an extension 33 of the sliding plate or actuator interlock 21. When the switch 50 is closed, as shown in FIG. 7, the cam 23 engages the extension 33 and causes an opening 28 of the actuator interlock 21 to engage the actuator 29. This engagement of the actuator 29 prevents its rotation and consequently the actuation of the switch 40 when the switch 50 is closed.

In greater detail, when the switch 50 is closed, the cam 23 of the actuator 22 engages the extension 33 of the actuator interlock 21 which raises the position of the actuator interlock 21. This engagement causes the actuator interlock 21 to reach it highest position relative to the actuators 22 and 29. As show in FIG. 6, in the preferred embodiment of the invention, the actuator interlock 21 is a sliding plate 21 which slides up and down on two slots 37 and 38 as a function of the position of the cam 23. In the preferred embodiment, the interlock 21 includes an opening 27 around the actuator 29 for the switch 40. Preferably, the shape of the opening 27 is such that when the interlock 21 is at its lowest point, as shown in FIG. 6, (which point corresponds to the position of the cam 23 when the switch 50 is open), the actuator 29 is in the circular portion of the opening 27 and thus the actuator 29 of the switch 40 may be rotated to actuate the switch 40. When the actuator interlock 21 is in its highest position, as shown in FIG. 7, (which point corresponds to the position of the cam 23 when the switch 50 is closed), the actuator 29 is in the square portion 28 of the opening 27 and thus the actuator 29 of the line selector switch 40 may not be rotated to actuate the switch 40. Thus, the actuator interlock 21 prevents the actuation of the switch 40 when the switch 50 is closed, but permits the actuation of the switch 40 when the switch 50 is open.

As the foregoing illustrates, therefore, in the exemplary electrical cabinet 10, the interlock mechanism 20 of the present invention is employed to: (i) prevent closure of the switch 50 as a function of the position of the door 60; (ii) prevent opening of the door 60 as a function of the position of the switch 50; and (iii) prevent actuation of the switch 40 as a function of the position of switch 50.

From the foregoing it can be seen that the present invention is directed first to a switch operator which uses a flexible shaft to overcome the disadvantages of known switch operators, and secondly, to an interlock mechanism that prevents the actuation of one or more switches in certain situations and also prevents the opening of a door based on the position of one or more of these switches. It is understood that changes may be made to the embodiments described above without departing from the broad inventive concepts thereof. For example, the switch operator and interlock mechanism of the present invention may be employed in electrical cabinets that contain only one switch, or alternatively, in electrical cabinets that contain more than two switches. Accordingly, this invention is not limited to the particular embodiments disclosed, but is intended to cover all modifications that are within the scope and spirit of the invention as defined by the appended claims.

What is claimed is:

1. An interlock mechanism for an electrical cabinet having first and second switches and a door, said door having a hasp, said interlock mechanism comprising:

switch interlock means for preventing the actuation of said second switch as a function of said first switch; and prevention means for preventing the opening of said door as a function of the position of said first switch, said prevention means comprising a cam having a hook for engaging the hasp of said door, the hook being adapted to engage the hasp of said door when said first switch is in a first position, but to disengage the hasp when said first switch is in a second position, said cam having a slot, and said interlock mechanism further comprising: a plunger having a spring and a first extension for engaging the slot of said cam as a function of the position of said first switch, and a second extension for engaging said door as a function of the position of the door.

2. An interlock mechanism according to claim 1, wherein the first extension of said plunger is adapted to engage the slot of said cam when said first switch is open and said door is open, and the second extension of said plunger is adapted to be pressed by said door when said door is closed so that when said door is closed the first extension does not engage the slot of said cam and so that when said door is open and said first switch is open the first extension engages the slot of said cam.

3. An interlock mechanism according to claim 2, wherein said switch interlock means includes a plate extending from an actuator for said second switch to a cam coupled to an actuator for said first switch and said plate is configured to engage and prevent the rotation of said actuator for said second switch as a function of the position of said first switch.

* * * * *